US009656129B1

(12) United States Patent
Tamashiro et al.

(10) Patent No.: US 9,656,129 B1
(45) Date of Patent: May 23, 2017

(54) GOLF BALL RETRIEVAL RAKE

(71) Applicants: Don Tamashiro, Red Deer County (CA); Terry Walker, Red Deer County (CA)

(72) Inventors: Don Tamashiro, Red Deer County (CA); Terry Walker, Red Deer County (CA)

( * ) Notice: Subject to any disclaimer, the term of this patent is extended or adjusted under 35 U.S.C. 154(b) by 0 days.

(21) Appl. No.: 15/229,524

(22) Filed: Aug. 5, 2016

(51) Int. Cl.
*A63B 47/02* (2006.01)

(52) U.S. Cl.
CPC ..... *A63B 47/02* (2013.01)

(58) Field of Classification Search
CPC ..... A63B 47/02; A63B 47/024; A01D 7/06; A01D 46/247; A01D 51/002; A01D 51/005
USPC ..... 294/19.2
See application file for complete search history.

(56) References Cited

U.S. PATENT DOCUMENTS 818,342 A * 4/1906 Bell ..... A01D 46/247 294/179
2,721,755 A 10/1955 Wainer
3,117,814 A * 1/1964 Webb ..... A63B 47/02 294/19.2
3,306,650 A 2/1967 Zagwyn
3,717,371 A * 2/1973 Halone ..... A63B 47/02 294/19.2
4,411,463 A 10/1983 Alderman
5,311,733 A 5/1994 Krenkel
5,662,366 A * 9/1997 Fraske ..... A63B 47/02 294/19.2
5,758,915 A 6/1998 Quinn et al.
6,695,370 B2 2/2004 Johnson
D506,517 S 6/2005 Crippen
7,178,844 B2 * 2/2007 Evilsizer ..... A63B 47/02 294/19.2
7,311,345 B2 * 12/2007 Kerr ..... A63B 47/02 294/19.2
7,938,465 B2 * 5/2011 Spacone ..... A63B 47/02 294/19.2

* cited by examiner

*Primary Examiner* — Dean Kramer
(74) *Attorney, Agent, or Firm* — Stevenson IP, LLC

(57) ABSTRACT

A golf ball retrieval rake including a telescopic handle and an attachment member on a handle front end which connects the handle to a scoop member. The scoop member includes a J-shaped plate having cylindrical tines disposed on a front side of the plate, which are provided to drag and pull a golf ball into the scoop member to bring the golf ball out of a hazard. Obround slots through a bottom side of the plate, obround openings in the side walls and in the plate rear side, and holes in the rear side permit drainage from the scoop member when a golf ball is retrieved from a water hazard on the golf course and to shake sand from the scoop member when a golf ball is retrieved from a sand trap. A single removable zippered cover encompasses the attachment member, the scoop member, and the tines.

6 Claims, 4 Drawing Sheets

GOLF BALL RETRIEVAL RAKE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Golfing is a popular sport throughout the world. One of the expenses incurred by the average golfer, in addition to the purchase of golf clubs, membership costs, cart rentals, is the purchase of golf balls. The loss of golf balls due to errant hits into integral golf course hazards, such as water hazards, sand traps, rough grassy areas and tall vegetation outside the fairways, is not only a major frustration to the golfer, but is also a potential source of great expense. Most golf balls are lost in the water hazards. Therefore, the ability to retrieve balls lost in any type of hazard, water or otherwise, is of great importance to most golfers, especially those with limited resources. Golf ball retrieval devices are known in the field of golfing. However, what is needed is a golf ball retrieval rake including a telescopic handle and an attachment member on a handle front end which connects the handle to a scoop member. The scoop member includes a J-shaped plate having cylindrical tines disposed on a front side of the plate, which are provided to drag and pull a golf ball into the scoop member to bring the golf ball out of a hazard. Obround slots through a bottom side of the plate, obround openings in the side walls and in the plate rear side, and holes in the rear side permit drainage from the scoop member when a golf ball is retrieved from a water hazard on the golf course and to shake sand from the scoop member when a golf ball is retrieved from a sand trap. A single removable zippered cover encompasses the attachment member, the scoop member, and the tines.

FIELD OF THE INVENTION

The present invention relates to golf accessories, and more particularly, to a golf ball retrieval rake.

SUMMARY OF THE INVENTION

The general purpose of the present golf ball retrieval rake, described subsequently in greater detail, is to provide a golf ball retrieval rake which has many novel features that result in a golf ball retrieval rake which is not anticipated, rendered obvious, suggested, or even implied by prior art, either alone or in combination thereof.

To accomplish this, the present golf ball retrieval rake includes a telescopic handle having a front end and a rear end. An attachment member, disposed on the front end of the handle, connects the handle to a scoop member. The scoop member includes a J-shaped plate having a convex top side, a convex rear side attached to the external side of the attachment member, a straight front side, a flat bottom side, a right side, and a left side. The top side has a length approximately one-fourth to one half a length of the bottom side. Each of a side wall, disposed along each of the entire right side and the entire left side, has upper and lower edges, a convex rear edge, a front edge, interior and exterior surfaces, and a convex rear segment of the upper edge of the side wall attached to the plate along the entire top side. The rear edge is attached to rear side proximal the respective right side and left side. The lower edge is attached to the respective one of the right side and the left side. A portion of the front edge is bulbous and protrudes forwardly of the front side of the plate. A plurality of obround slots disposed longitudinally through the bottom side and a plurality of obround openings in the side walls and in the plate rear side, and a plurality of holes in the rear side are provided along with the slots to permit drainage from the scoop member when a golf ball is retrieved from a water hazard on the golf course and to shake sand from the scoop member when a golf ball is retrieved from a sand trap. Cylindrical tines on the front side of the plate are provided to drag, grab, and pull a golf ball into the scoop member to bring the golf ball to either to the shore or directly to the golfer. A single removable zippered cover encompasses the attachment member, the scoop member, and the tines.

Thus has been broadly outlined the more important features of the present golf ball retrieval rake so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
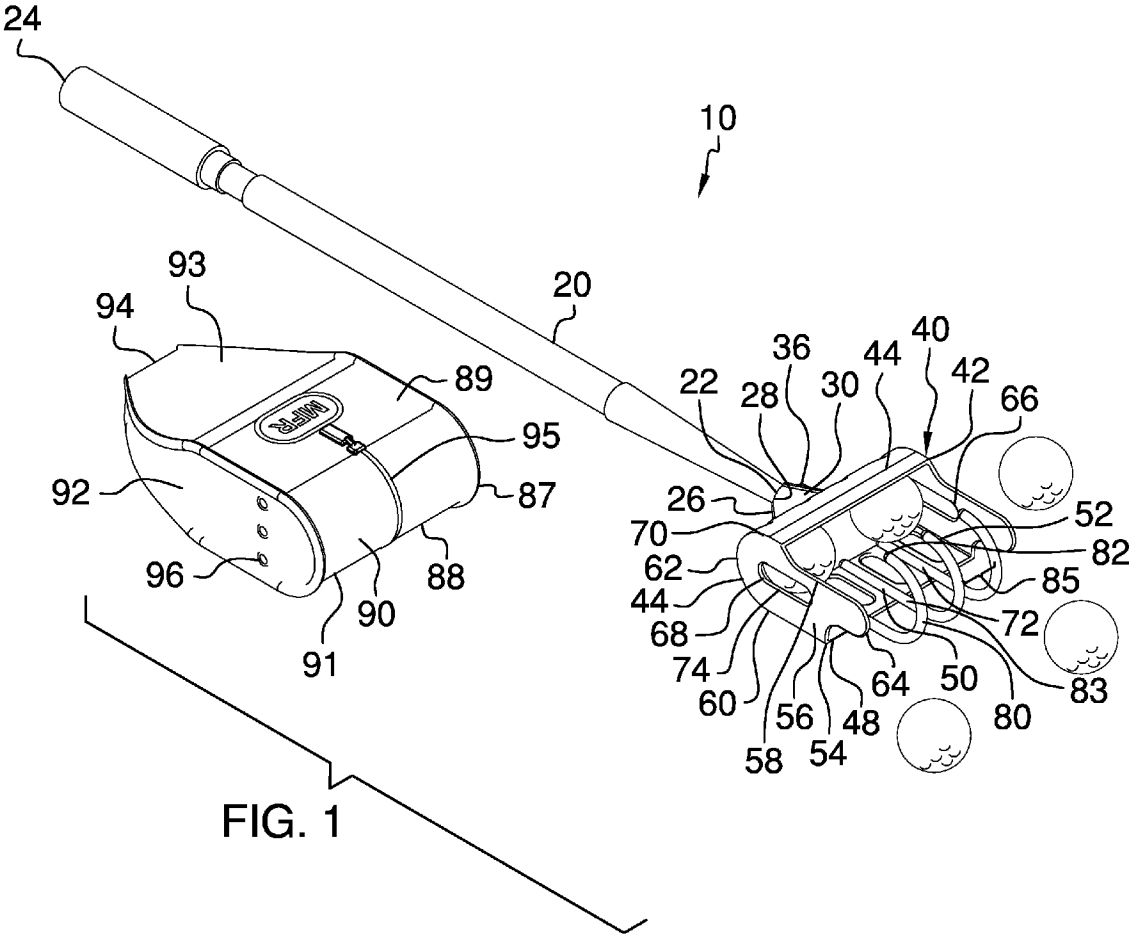
FIG. 1 is an isometric view with a handle in an extended condition.
Figure 2:
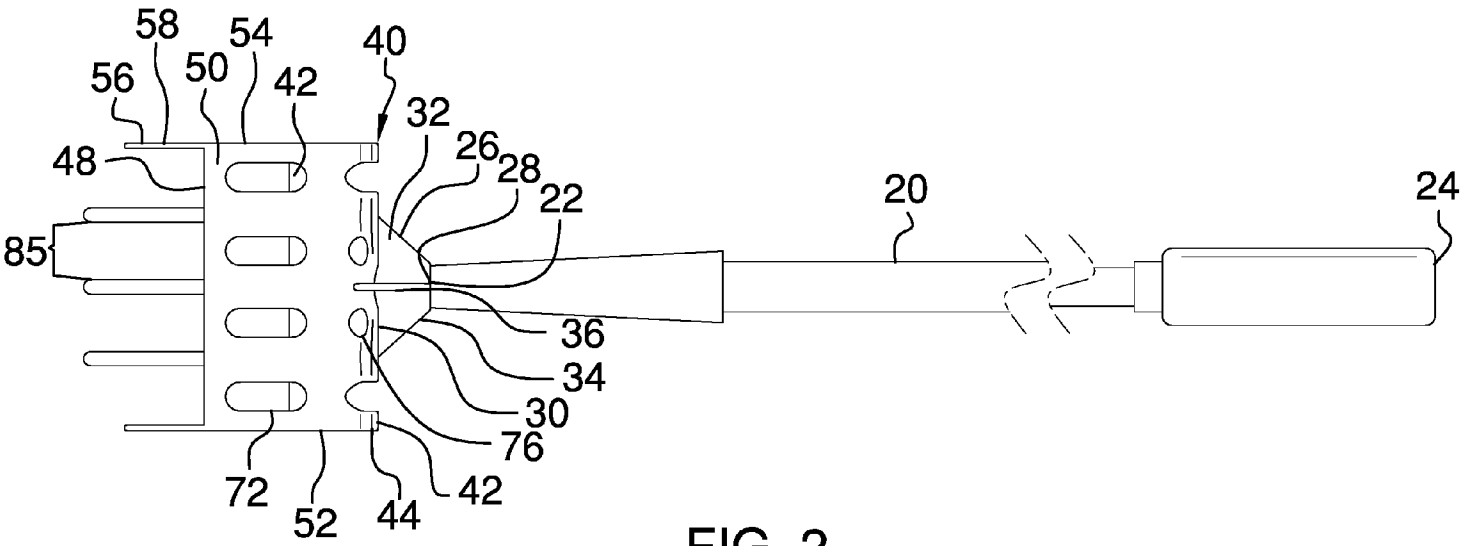
FIG. 2 is a bottom plan view.
Figure 3:
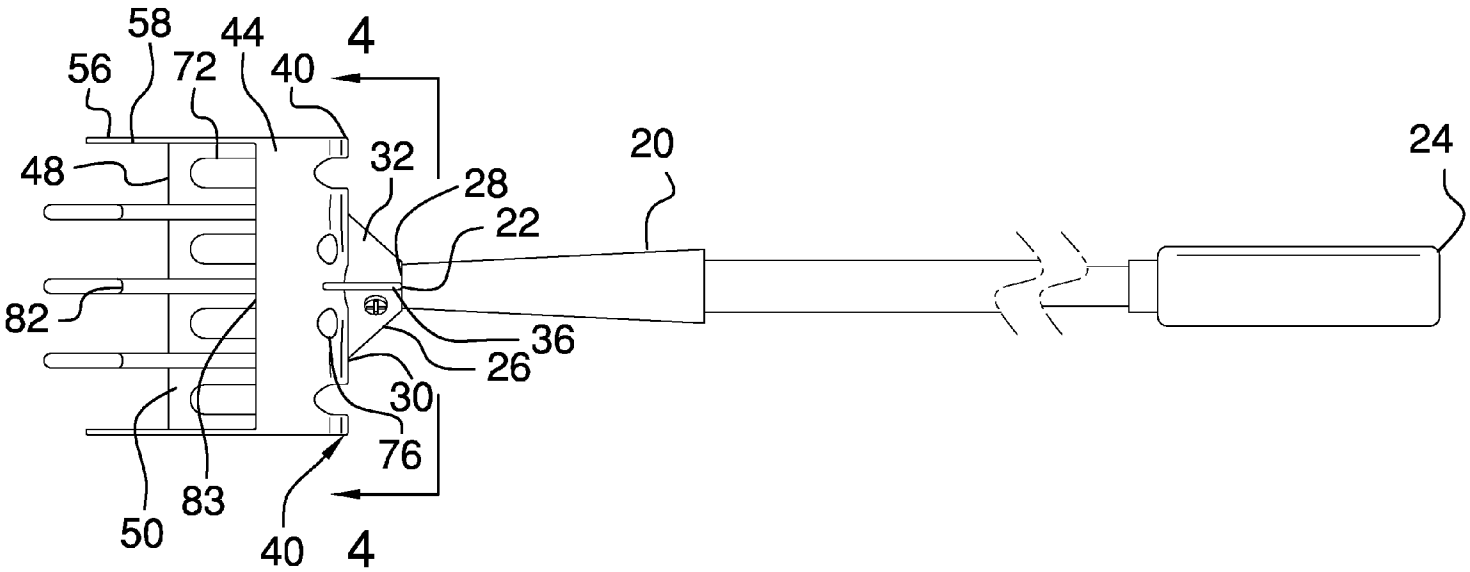
FIG. 3 is a top plan view.
Figure 4:
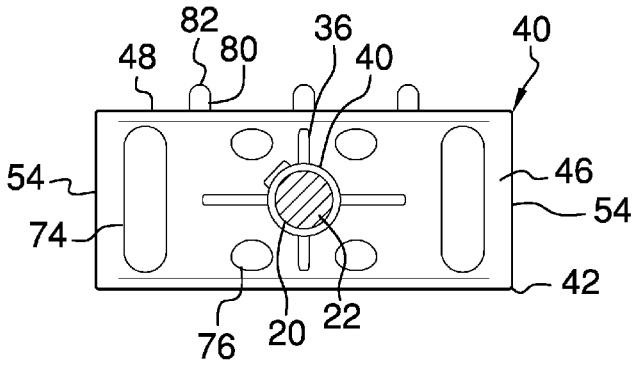
FIG. 4 is a rear elevation view.
Figure 5:
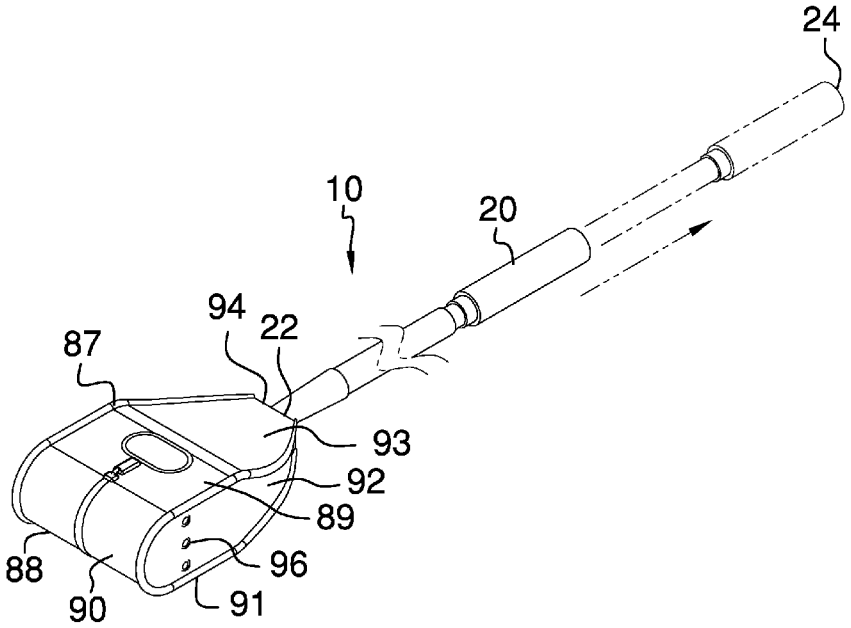
FIG. 5 is an isometric view with the handle in a retracted condition.

With reference now to the drawings, and in particular FIGS. 1 through 5 thereof, an example of the instant golf ball retrieval rake employing the principles and concepts of the present golf ball retrieval rake and generally designated by the reference number 10 will be described.

Referring to FIGS. 1 through 5 the present golf ball retrieval rake 10 is illustrated. The golf ball retrieval rake 10 includes a telescopic handle 20 having a front end 22 and a rear end 24. An attachment member 26 is disposed on the front end 22 of the handle 20. The attachment member 26 has an internal side 28 attached to the front end 22, an external side 30 opposite the internal side 28, a trapezoidal upper surface 32, a trapezoidal lower surface 34, and a parallelepiped raised brace 36 disposed along a longitudinal midline axis of each of the upper surface 32 and the lower surface 34.

A scoop member 40 is disposed on the external side 30 of the attachment member 26. The scoop member 40 includes a J-shaped plate 42. The plate 42 has a convex top side 44, a convex rear side 46 attached to the external side 30 of the attachment member 26, a straight front side 48, a flat bottom side 50, a right side 52, and a left side 54. The top side 44 has a length approximately one-fourth to one half a length of the bottom side 50. The raised brace 36 extends from the internal side 28 of the attachment member 26 to the each of the top side 44 and the bottom side 50 of the plate 42 proximal the rear side 46. A side wall 56 is disposed along each of the entire right side 52 and the entire left side 54. The side wall 56 has an upper edge 58, a lower edge 60, a convex rear edge 62, a front edge 64, an interior surface 66, and an exterior surface 68, and a convex rear segment 70 of the upper edge 58 of the side wall 56 attached to the plate 42 along the entire top side 44. The rear edge 62 is attached to rear side 46 proximal the respective right side 52 and left side 54. The lower edge 60 is attached to the respective one of the right side 52 and the left side 54. A portion of the front edge 64 is bulbous and protrudes forwardly of the front side 48 of the plate 42.

A plurality of obround slots 72 is disposed longitudinally through the bottom side 50 in a position parallel to each other and perpendicular to the front side 48. A plurality of obround openings 74 is provided along with the slots 72 to permit drainage from the scoop member 40 when a golf ball is retrieved from a water hazard on the golf course. One of the obround openings 74 is disposed through each of a respective one of the side walls 56 in a position substantially parallel to the lower edge 60 and through the rear side 46 of the plate 42 proximal each of the right side 52 and the left side 54. A plurality of holes 76 is disposed in the rear side 46 between the obround openings 74 therein and a portion of the attachment member 26. The holes 76 also assist in drainage of water from the scoop member 40.

A plurality of spaced-apart cylindrical tines 80 is provided to drag, grab, and pull a golf ball into the scoop member 40. Each tine 80 has a convex leading edge 82 and an opposing trailing edge 83 disposed on the front side 48 of the plate 42, and a gap 85 extending therebetween spaced apart from an opposing surface of an adjacent tine 80 a distance greater than a diameter of a golf ball for enabling the tines 80 to guide the golf ball therebetween. To use the present device 10, a golfer adjusts the telescopic handle 20 to a proper length for reaching the golf ball and rakes the golf ball from a water hazard, a clump of weeds, a bush, a sand trap, or other location in which a golf ball is trapped with the tines 80 into the scoop member 40. When the golf ball is retrieved from a water hazard, once the golf ball is raked into the scoop member 40, the golfer twists the handle 20 to flip and turn over the rake to bring a golf ball to either to the shore or directly to the golfer.

A single removable cover 87 encompasses the attachment member 26, the scoop member 40, and the tines 80. The cover 87 conforms to a combined shape of the attachment member 26, the scoop member 40, and the tines 80. The cover 87 has a J-shaped center portion 88 having an upper wall 89, a convex forward wall 90, a lower wall 91, a pair of external walls 92, and a rear wall 93. The rear wall 93 has a central aperture 94 therethrough. The aperture 94 has a diameter configured to receive the front end 22 of the handle 20 therethrough. A zipper 95 is disposed along a portion of the upper wall 89 and at least a portion of forward wall 90. A plurality of round vent holes 96 is disposed on each of the external walls 92 of the cover 87.

What is claimed is:

1. A golf ball retrieval rake comprising:

a handle having a front end and a rear end;

an attachment member disposed on the front end of the handle, the attachment member having an internal side attached to the front end, an external side opposite the internal side, a trapezoidal upper surface, a trapezoidal lower surface, and a parallelepiped raised brace disposed along a longitudinal midline axis of each of the upper surface and the lower surface;

a scoop member disposed on the external side of the attachment member, the scoop member comprising:

J-shaped plate having a convex top side, a convex rear side attached to the external side of the attachment member, a straight front side, a flat bottom side, a right side, and a left side, wherein the top side has a length approximately one-fourth to one half a length of the bottom side, the raised brace extending from the internal side of the attachment member to the each of the top side and the bottom side of the plate proximal the rear side;

a side wall is disposed along each of the entire right side and the entire left side, the side wall having an upper edge, a lower edge, a convex rear edge, a front edge, an interior surface, and an exterior surface, a convex rear segment of the upper edge of the side wall attached to the plate along the entire top side, the rear edge attached to rear side proximal the respective right side and left side, the lower edge attached to the respective one of the right side and the left side, a portion of the front edge being bulbous and protruding forwardly of the front side of the plate;

a plurality of slots is disposed longitudinally through the bottom side in a position parallel to each other and perpendicular to the front side;

an opening disposed through each of the side walls in a position substantially parallel to the lower edge;

a plurality of spaced-apart cylindrical tines, each tine having a convex leading edge and an opposing trailing edge disposed on the front side of the plate, and a surface extending therebetween spaced apart from an opposing surface of an adjacent tine a distance greater than a diameter of a golf ball for enabling the tines to guide the golf ball therebetween.

2. The golf ball retrieval rake of claim 1 wherein each of the slots and the openings is obround.

3. The golf ball retrieval rake of claim 1 comprising a single removable cover encompassing the attachment member, the scoop member, and the tines, wherein the cover conforms to a combined shape of the attachment member, the scoop member, and the tines.

4. A golf ball retrieval rake comprising:

a telescopic handle having a front end and a rear end;

an attachment member disposed on the front end of the handle, the attachment member having an internal side attached to the front end, an external side opposite the internal side, a trapezoidal upper surface, a trapezoidal lower surface, and a parallelepiped raised brace disposed along a longitudinal midline axis of each of the upper surface and the lower surface;

a scoop member disposed on the external side of the attachment member, the scoop member comprising:

J-shaped plate having a convex top side, a convex rear side attached to the external side of the attachment member, a straight front side, a flat bottom side, a right side, and a left side, wherein the top side has a length approximately one-fourth to one half a length of the bottom side, the raised brace extending from the internal side of the attachment member to the each of the top side and the bottom side of the plate proximal the rear side;

a side wall is disposed along each of the entire right side and the entire left side, the side wall having an upper edge, a lower edge, a convex rear edge, a front edge, an interior surface, and an exterior surface, a convex rear segment of the upper edge of the side wall attached to the plate along the entire top side, the rear edge attached to rear side proximal the respective right side and left side, the lower edge attached to the respective one of the right side and the left side, a portion of the front edge being bulbous and protruding forwardly of the front side of the plate;

a plurality of obround slots is disposed longitudinally through the bottom side in a position parallel to each other and perpendicular to the front side;

a plurality of obround openings, wherein one of the obround openings is disposed through each of a respective one of the side walls in a position substantially parallel to the lower edge and through the rear side of the plate proximal each of the right side and the left side;

a plurality of holes disposed in the rear side between the obround openings therein and a portion of the attachment member;

a plurality of spaced-apart cylindrical tines, each tine having a convex leading edge and an opposing trailing edge disposed on the front side of the plate, and a surface extending therebetween spaced apart from an opposing surface of an adjacent tine a distance greater than a diameter of a golf ball for enabling the tines to guide the golf ball therebetween.

5. The golf ball retrieval rake of claim 4 comprising a single removable cover encompassing the attachment member, the scoop member, and the tines, wherein the cover conforms to a combined shape of the attachment member, the scoop member, and the tines, the cover having a J-shaped center portion having an upper wall, a convex forward wall, a lower wall, a pair of external walls, a rear wall having a central aperture therethrough, the aperture having a diameter configured to receive the front end of the handle therethrough, and a zipper disposed along a portion of the upper wall and at least a portion of forward wall.

6. The golf ball retrieval rake of claim 5 comprising a plurality of round vent holes disposed on each of the external walls of the cover.

* * * * *